United States Patent [19]

Sase

[11] 3,966,059

[45] June 29, 1976

[54] PAPER FEEDING APPARATUS FOR AN AUTOMATIC PLANE TYPE PAPER PUNCHING MACHINE

[76] Inventor: Eizo Sase, No, 1991 Daikan-cho, Tatebayashi, Gunma, Japan

[22] Filed: Oct. 3, 1974

[21] Appl. No.: 511,731

[52] U.S. Cl. ..... 214/8.5 SS; 214/8.5 G
[51] Int. Cl.[2] ..... B65G 59/02
[58] Field of Search ..... 214/8.5 SS, 8.5 A, 8.5 C

[56] References Cited

UNITED STATES PATENTS

| | | | |
|---|---|---|---|
| 3,327,873 | 6/1967 | Malamood | 214/8.5 C |
| 3,690,476 | 9/1972 | Stacy | 214/8.5 SS |

*Primary Examiner*—Albert J. Makay
*Attorney, Agent, or Firm*—Wenderoth, Lind & Ponack

[57] ABSTRACT

A paper feeding apparatus for an automatic plane type paper punching machine comprising a punching unit to punch stacked sheets of paper so as to obtain a predetermined shape and size of said stacked sheets of paper and a paper catcher to receive from said paper feeding apparatus and to catch and deliver to said punching unit said stacked sheets of paper to be punched, said paper feeding apparatus comprising a base to mount thereon a stack of sheets paper; separator means to separate predetermined sheets of paper from said stack; and means to clamp and carry said separated sheets of paper from the remaining stack to said paper catcher. Separator means includes an arm member movable back and forth relative to said stack and a pawl member mounted on said arm member at one end to be inserted into the layers of said stack at a first level and to raise up said predetermined sheets of paper to a second level. Clamping and carrying means includes a clamper movable back and forth relative to said stack to clamp said separated sheets of paper.

8 Claims, 3 Drawing Figures

PAPER FEEDING APPARATUS FOR AN AUTOMATIC PLANE TYPE PAPER PUNCHING MACHINE

FIELD OF THE INVENTION

This invention pertains generally to a paper feeding apparatus for an automatic plane type paper punching machine, and more particularly to a paper feeding apparatus wherein some sheets of paper are separated and carried from a stack of paper sheets and delivered to a paper catcher which catches and transfers the separated sheets of paper to a punching unit of the automatic plane type punching machine.

BACKGROUND OF THE INVENTION

A conventional paper feeding apparatus comprises a vacuum type feeder by means of which each sheet of paper is carried from a stack of paper sheets to a paper catcher which in turn has a pair of catching pawls to catch therebetween the sheets of paper received from the feeder. Generally, the plane type paper punching machine has a capacity of punching twenty to thirty sheets of paper onece. Therefore, feeding each sheet of paper to the machine for each cycle of movement of the feeding apparatus causes the latter to ineffectively operate.

A semi-automatic paper feeding apparatus has been also utilized wherein an operator or operators carry three or four sheets of paper to a paper catcher in which they are caught by the catching pawls for punching them by a punching machine. But, such apparatus requires the operator or operators always standby for the operation of the machine and causes it to operate at a limited rate due to the manual feed of paper.

SUMMARY OF THE INVENTION

Accordingly, it is a principal object of the invention to provide a paper feeding apparatus for an automatic plane type paper punching machine adapted to automatically feed a plurality of sheets of paper from a stack of paper sheets whereby the operation of the paper punching machine is effectively accomplished.

In accordance with the present invention, there is provided a paper feeding apparatus for an automatic plane type paper punching machine comprising a punching unit to punch stacked sheets of paper so as to obtain a predetermined shape and size of said stacked sheets of paper and a paper catcher to receive from said paper feeding apparatus and to catch and deliver to said punching unit said stacked sheets of paper to be punched, said paper feeding apparatus comprising a base to mount thereon a stack of sheets of paper; separator means to separate predetermined sheets of paper from said stack, said separator means including an arm member movable back and forth relative to said stack and a pawl member mounted on said arm member at one end to be inserted into the layers of said stack at a first level and to raise up said predetermined sheets of paper to a second level; and means to clamp and carry said separated sheets of paper from the remaining stack to said paper catcher, said clamping and carrying means having a clamper movable back and forth relative to said stack to clamp said separated sheets of paper.

BRIEF DESCRIPTION OF THE DRAWINGS

The above and other objects and features of the present invention will be apparent from the detailed description of the preferred embodiment of the present invention taken in connection with the accompanying drawings in which.

DETAILED DESCRIPTION OF THE PREFERRED EMBODIMENT OF THE PRESENT INVENTION

Figure 1:
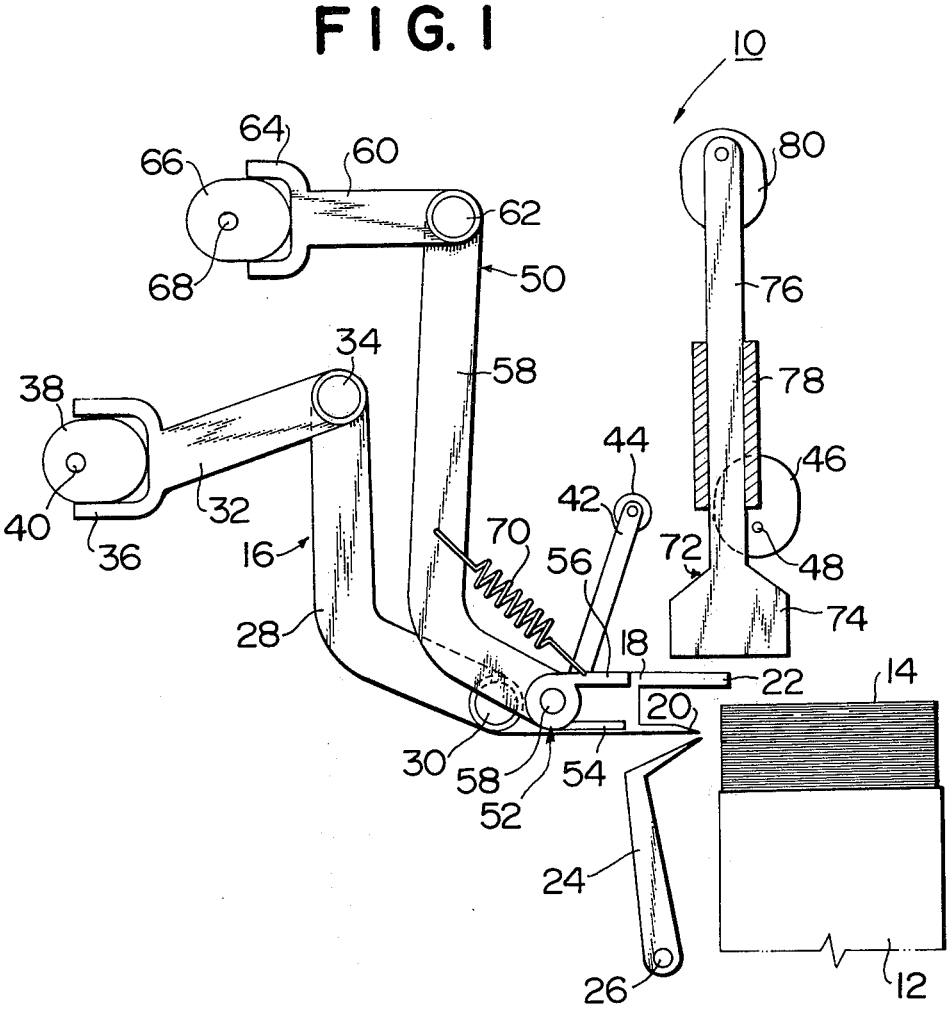
FIG. 1 is a diagramatic side elevational view of one embodiment of a paper feeding apparatus for an automatic plane type paper punching machine in accordance with the present invention.

Referring now to FIG. 1, a paper feeding apparatus for an automatic plane type paper punching machine is generally indicated by numeral 10 and comprises a base 12 to mount thereon a stack 14 of sheets of paper.

Figure 2:
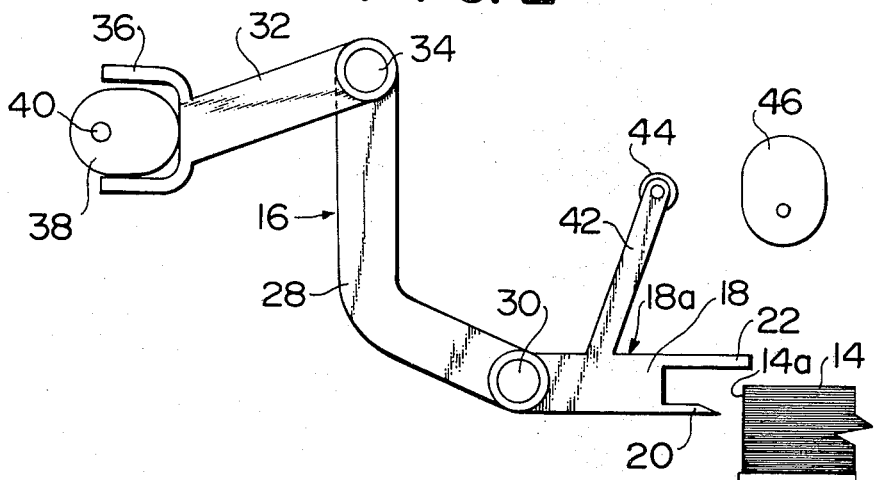
FIG. 2 is a diagramatic side elevational view of separator means in a back position, used in the apparatus of FIG. 1.

The apparatus 10 also comprises a separator 16 to separate predetermined sheets of paper from the stack 14. The separator 16, which is also illustrated in FIG. 2, includes an arm member 18 which in turn has a pawl 20 provided on the leading edge at the lower portion and a projecting portion 22 provided on the leading edge at the upper portion and extending slightly beyond the edge of the pawl 20. The pawl member 20 serves to separate predetermined sheets of paper 14*a* from the remaining stack 14 by immersing it into the layers of the stack 14 on forward movement of the arm member. The projecting portion 22 serves to prevent the separated sheets of paper 14*a* from being blown up. As shown in FIG. 1, an air nozzle 24 may be provided which may be pivotally mounted about a pin 26 so as to move back and forth relative to the stack 14. The air nozzle 24 serves to inject air between the lowermost sheet of the separated sheets 14*a* and the uppermost sheet of the remaining stack 14 to promote removal of the former from the latter.

Referring again to FIG. 2, the arm member 18 may be preferably secured at the opposite end to a first lever arm 28 at one end and they are pivotally mounted about a pin 30 at the connection between them. The first lever arm 28 at the other end may be secured to a second lever arm 32 at one end and they are also pivotally mounted about a fixed pin 34 at the connection between them. The second lever arm 32 at the other end may be provided with a forked portion 36 which engages a cam 38 rotatable about an axis 40. Thus, rotation of the cam 38 causes the second arm 32 to swingingly move about the pin 34 in an upward or downward direction as viewed in FIG. 1. The upward or downward movement of the second lever arm 32 allows the first lever arm 28 to swingingly move back and forth about the pin 34 so that the arm member 18 may be retracted and advanced relative to the stack 14 on the base 12.

The arm member 18 may be provided with an extension 42 integral with and upwardly and inclinatorily extending from the upper edge 18*a* of the arm member 18. The extension 42 may be provided with a roller 44 which is rotatably mounted on the upper end of the extension. A fixed cam 46 is positioned to engage the roller 44 when the arm member 18 and therefore, the roller 44 are in an advanced position. Thus, with the arm member 18 advanced relative to the stack 14, the pawl 20 separates predetermined sheets of paper 14*a* from the remaining stack 14 and then the continued advanced movement of the arm member 18 causes the roller to engage the cam 46, thereby causing the roller together with the arm member 18 to be raised up while the pawl member 20 holds the separated sheets of paper thereon.

Figure 3:
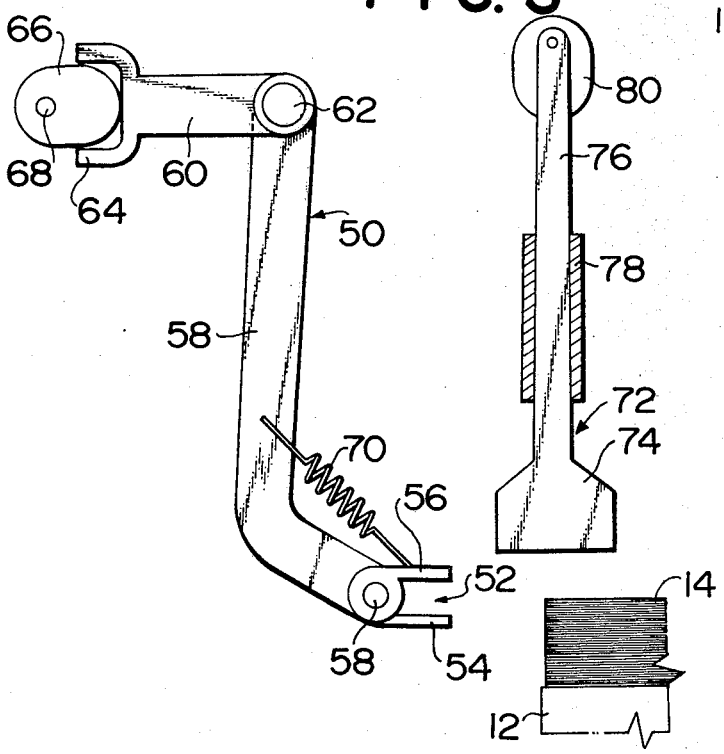
FIG. 3 is a diagramatic side elevational view of clamping and carrying means in a back position, used in the apparatus of FIG. 1.

The paper feeding apparatus 10 also comprises clamping and carrying means 50 to hold and carry the separated sheets of paper 14*a* to a paper catcher in a paper punching machine (not shown). Clamping and carrying means may comprise a clamper 52 to clamp the separated sheets of paper 14*a*, which clamper includes a stationary jaw 54 and a movable jaw 56 pivoted about a pin 58 as shown in FIG. 3. The clamper 52 is movable back and forth relative to the stack 14 as described hereinafter. After the separator 16 separates the predetermined sheets of paper 14*a* from the remaining stack 14 as previously described, the clamper 52 advances and clamps the separated sheets of paper by pivotting the movable jaw 56 so as to approach the stationary jaw 54.

The clamper 52 at the stationary jaw 54 may be secured to a first lever arm 58 at one end, the other end of which may be secured to a second lever arm 60 at one end. The first and second lever arms 58 and 60 may be pivotally mounted about a fixed pin 62 at the connection between them. The second lever arm 60 at the other end may be provided with a forked portion 64 which engages a cam 66 rotatable about an axis 68. Thus, rotation of the cam 66 causes the second lever arm 60 to swingingly move about the pin 62 in an upward or downward direction as viewed in FIGS. 1 and 3. The upward and downward movement of the second lever arm 60 allows the first lever arm 58 to swingingly move back and forth about the pin 62 so that the clamper 52 may be retracted and advanced relative to the stack 14 on the base 12.

As seen from FIG. 3, a spring 70 is secured to and tensioned between the movable jaw 56 and the first lever arm 58 so that the movable jaw 56 is urged away from the stationary jaw 54. A pusher 72 may be provided in the position corresponding to the advanced position of the clamper 52 so that the advanced clamper 52 may close the jaws 56 and 54 by engagement of the pusher 72 with the movable jaw 56. The pusher 72 comprises a pushing head 74 integral with a lower end of a rod 76 which extends through a fixed bush 78. The rod 76 may be pivotally connected at the upper end to an eccentric 80 so that the rod 76 is movable upward and downward in response to rotation of the eccentric 22. After the clamper 52 advances and receives the sheets of paper separated by the separator 16, the eccentric 80 causes the pushing head 74 of the pusher 72 to be lowered so that the head 74 is engaged against the movable jaw 56 of the clamper 52 to thereby close the same.

Briefly, the separator 16 advances and separates the predetermined sheets of paper 14*a* from the remaining stack 14 as previously described. Then the clamper 52 advances and clamps the separated sheets of paper 14*a*. Thereafter, the clamper is retracted while it holds them until the clamper is disengaged with the pushing head 74 of the pusher 72. Then, the paper catcher (not shown) receives the separated sheets 14*a* carried by the movable clamper 52. Simultaneously, the clamper 52 is opened by disengagement with the pusher 72. Thereafter, the pushing head 74 is raised up by the eccentric 80 for subsequent operation. Thus, the predetermined sheets of paper received by the paper catcher are delivered to and punched by a punching unit (not shown) of the automatic plane type punching machine. It will be understood that the number of sheets of paper to be punched depends on the level at which the pawl member 20 is inserted into the layers of the stack 14. The number of sheets which can be separated and delivered to the paper punching machine may range from 5 to 50 sheets.

While one preferred embodiment of the present invention has been illustrated and shown with reference to the accompanying drawings, it will be apparent to those skilled in the art that it is only by way of example and that various changes and modifications may be made without the spirit and scope of the present invention, which is intended to be defined only to the appended claims.

What is claimed is:

1. A paper feeding apparatus for an automatic plane type paper punching machine comprising a punching unit to punch stacked sheets of paper so as to obtain a predetermined shape and size of said stacked sheets of paper and a paper catcher to receive from said paper feeding apparatus and catch and deliver to said punching unit said stacked sheets of paper to be punched, said paper feeding apparatus comprising a base to mount thereon a stack of sheets of paper; separator means to separate predetermined sheets of paper from said stack, said separator means including an arm member movable back and forth relative to said stack and a pawl member means mounted on said arm member at one end thereof to be inserted into the layers of said stack at a first level means mounted on the separator and operatively associated with a fixed means for rising said predetermined sheets of paper to a second level; means to clamp and carry said separated sheets of paper from the remaining stack to said paper catcher, said clamping and carrying means including a clamper movable back and forth relative to said stack to clamp said separated sheets of paper.

2. A paper feeding apparatus as set forth in claim 1, wherein said separator means further comprises a projecting portion provided on said arm member in a facing relation to said pawl member whereby said separated sheets of paper are held between said projecting portion and said pawl member.

3. A paper feeding apparatus as set forth in claim 1, wherein said arm member is mounted on lever means pivotally movable about an axis, said lever means operatively associated with a cam rotatable about an axis.

4. A paper feeding apparatus as set forth in claim 3, wherein said means mounted on said separator comprises an extension integral with said arm member and provided with a roller at the end of said extension and said fixed means comprises a cam positioned to engage said roller when said arm member advances relative to said stack whereby said arm member is raised up.

5. A paper feeding apparatus as set forth in claim 1, wherein said clamper comprises a stationary jaw and a movable jaw resiliently urged away from said stationary jaw and said clamper including a pusher engaging said movable jaw when said clamper advances relative to said stack to close said clamper with said separated sheets of paper held between said jaws.

6. A paper feeding apparatus as set forth in claim 5, and said pusher comprising a pushing head integral with a rod movable in an axial direction.

7. A paper feeding apparatus as set forth in claim 1, wherein said clamper is mounted on lever means pivotally movable about an axis, said lever means operatively associated with a cam rotatable about an axis.

8. A paper feeding apparatus as set forth in claim 3, wherein said arm member is pivotable relative to said lever means at the connection between said arm member and said lever means whereby said pawl member is inserted into said stack at variable level.

* * * * *